United States Patent [19]

Cho

[11] Patent Number: 4,946,517

[45] Date of Patent: Aug. 7, 1990

[54] UNRECRYSTALLIZED ALUMINUM PLATE PRODUCT BY RAMP ANNEALING

[75] Inventor: Alex Cho, Richmond, Va.

[73] Assignee: Aluminum Company of America, Pittsburgh, Pa.

[21] Appl. No.: 256,520

[22] Filed: Oct. 12, 1988

[51] Int. Cl.[5] ..... C22F 1/04

[52] U.S. Cl. ..... 148/12.7 A; 148/415; 148/417; 148/439; 148/440

[58] Field of Search ..... 148/11.5 A, 12.7 A, 148/2, 415, 417, 439, 440

[56] References Cited

U.S. PATENT DOCUMENTS 4,092,181 5/1978 Paton et al. ..... 148/12.7 A

*Primary Examiner*—R. Dean

*Attorney, Agent, or Firm*—Andrew Alexander

[57] ABSTRACT

Disclosed is a method of producing an unrecrystallized Al-Zn-Mg thin gauge flat rolled product having improved levels of strength and fracture toughness. The method comprising the steps of providing a body of a Zn-Mg containing aluminum base alloy, working the body to a flat rolled product and then subjecting the product to a ramp anneal followed by solution heat treating, quenching and aging.

78 Claims, 1 Drawing Sheet

UNRECRYSTALLIZED ALUMINUM PLATE PRODUCT BY RAMP ANNEALING

INTRODUCTION

This invention relates to heat treatable alloys such as the AA2000, 6000 and 7000 series alloys and more specifically, it relates to thermal or thermal mechanical processing of such alloys to improve strength and fracture toughness in thin plate, for example.

For many years, alloys of the 7000 series have been used for high strength and toughness in aerospace applications. These alloys can be age hardened to very high strengths, for example, in the T6 temper condition. Further, the strengths of these alloys may be increased by increasing solute content. Increasing the strength of these alloys permits designers to reduce the weight of aircraft by reducing thickness of load carrying components such as upper wing skins. Such components must have (and even demand) relatively high fracture toughness as well as high strength to be useful. Several sources indicate that plate having an unrecrystallized structure develops higher toughness than plate having a recrystallized structure. It is well known by those skilled in the art that maintaining the rolling temperature at a high level, typically above about 750° F., allows the aluminum alloy to dynamically recover with a fine subgrain structure, typically about 1 to 2 μm. This dynamically recovered structure is resistant to recrystallization during subsequent solution heat treatment. However, as the increased strength and toughness allows the use of thinner gauges, prior fabricating techniques and thermal mechanical practices often do not permit production of such products with an unrecrystallized structure because of the tendency for the rolling temperature to fall as the plate thickness is reduced.

Prior art teaches how to achieve recrystallized grain structure but not how to achieve unrecrystallized structure. In the prior art, U.S. Pat. No. 4,092,181 discloses a method of imparting a fine grain recrystallized structure to aluminum alloys having precipitating constituents. The method is provided for imparting a fine grain structure to aluminum alloys which have precipitating constituents. The alloy is first heated to a solid solution temperature to dissolve the precipitating constituents in the alloy. The alloy is then cooled, preferably by water quenching, to below the solution temperature and then overaged to form precipitates by heating it above the precipitation hardening temperature for the alloy but below its solution treating temperature. Strain energy is introduced into the alloy by plastically deforming it at or below the overaging temperature used. The alloy is then subsequently held at a recrystallization temperature so that the new grains are nucleated by the overaged precipitates and the development of these grains results in a fine recrystallized grain structure. This structure is useful for imparting superplastic properties but will provide lower toughness than an unrecrystallized structure.

In contrast, the present invention provides improved thermal or thermal mechanical processing techniques which permit the fabrication of flat rolled products, particularly thin gauge plate and sheet 7000 series aluminum alloys having a substantially unrecrystallized structure which imparts to the plate improved combinations of strength and fracture toughness.

SUMMARY OF THE INVENTION

A principal object of this invention is to provide an improved aluminum based, heat treatable, flat rolled product.

Another object of this invention is to provide an unrecrystallized, 7000 series alloy, thin gauge plate or sheet product.

Yet another object of this invention is to provide a process for making an unrecrystallized, 7000 series alloy, thin gauge flat rolled product.

These and other objects will become apparent from the specification, drawings and claims appended hereto.

In accordance with these objects, there is provided an unrecrystallized thin gauge flat rolled product suitable for fabricating into aircraft structural members, the unrecrystallized thin gauge flat rolled product comprised of an aluminum base alloy selected from 2000, 6000 or 7000 series alloys. For 7000 series, the alloy can consist essentially of 1.0 to 12 wt. % Zn, 0.5 to 4.0 wt. % Mg, max. 3.0 wt. % Cu, max. 1.0 wt. % Mn, max. 0.5 wt. % each of Si, Fe, Cr, Ti, Zr, Sc and Hf, the balance aluminum and impurities.

Also, there is provided a method of producing an unrecrystallized, thin gauge flat rolled product which includes hot working a body of the alloy to a thin gauge flat rolled product then subjecting the product to a ramp anneal wherein the annealing temperature is increased with time of anneal. This is followed by solution heat treating, quenching and aging to provide a substantially unrecrystallized product having improved levels of strength and fracture toughness.

DETAILED DESCRIPTION OF THE PREFERRED EMBODIMENTS

Figure 1:
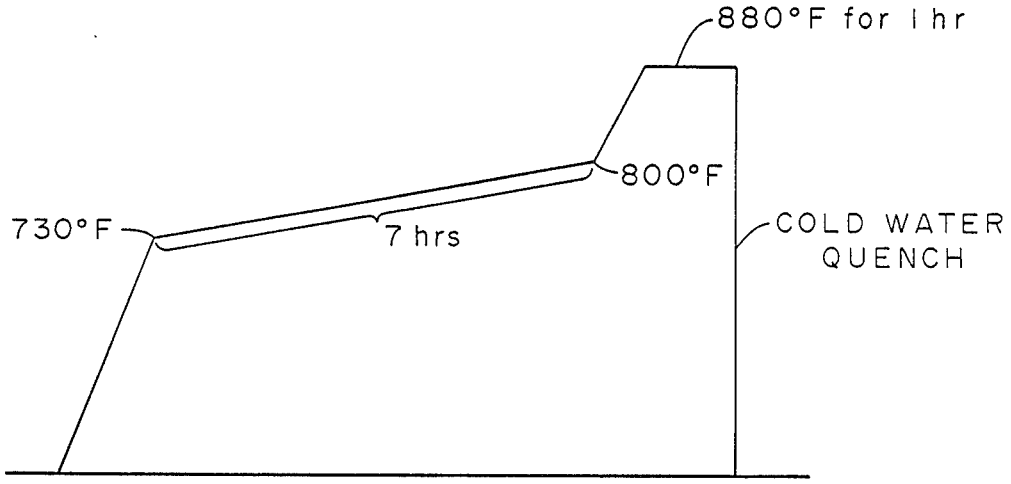
FIG. 1 is a diagram of a ramp anneal in accordance with the invention.

Aluminum based alloys which respond to thermal mechanical processing in accordance with the present invention include the Aluminum Association 7000 series. Such alloys include, for example, 7050, 7150, 7075, 7475, 7049 and 7039.

Typically, these aluminum based alloys contain 1.0 to 12.0 wt. % Zn, 0.5 to 4.0 wt. % Mg, max. 3.0 wt. % Cu, max. 1.0 wt. % Mn, max. 0.5 wt. % each of Si, Fe, Cr, Ti, Zr, Sc and Hf, the balance aluminum, incidental elements and impurities. These alloys may be referred to as Al-Zn-Mg or Al-Zn-Cu-Mg type. Alloys which seem to respond more readily to thermal mechanical processing in accordance with the present invention include higher levels of zinc, preferably 7.0 to 12.0 wt. % Zn with a typical level being 8.0 to 11.0 wt. %. Magnesium at these levels of zinc can range from 0.2 to 3.5, preferably 0.4 to 3.0 wt. %. Also, copper at the higher zinc levels can range from 0.5 to 3.0 wt. %, preferably 1.0 to 3.0 wt. %. These alloying elements may be higher in certain cases, but the resulting alloys can have low fracture toughness. In certain cases, other ranges of alloying elements may be preferred. For example, Zn can be in the range of 7.0 to 9.0 wt. %, Mg 1.5 to 2.5 wt. %, Cu 1.9 to 2.7 wt. %, Zr, 0.08 to 0.14, with impurities such as Fe and Si being less than 0.3 wt. %. The Aluminum Association composition limits encompassing 7050 and 7150 are: 5.7 to 6.9 wt. % Zn, 1.9 to 2.7 wt. % Mg, 1.9 to 2.6 wt. % Cu, 0.05 to 0.15 wt. % Zr, max. 0.12 wt. % Si, max. 0.15 wt. % Fe, max. 0.10 wt. % Mn, max. 0.06 wt. % Ti, max. 0.04 wt. % Cr, the balance aluminum and incidental elements and impurities.

While the AA7000 series aluminum alloys have been described in detail, it will be understood that the invention can be applied to other heat treatable alloys such as the AA2000 and 6000 series aluminum alloys as well as AA8000 alloys which include lithium, e.g., 8090 and 8091. Thus, typical AA2000 series alloys which may be included are AA2024, 2124, 2324, 2219, 2519, 2014, 2618, 2034, 2090 and 2091, and typical of AA6000 series alloys are 6061 and 6013. Products formed from these alloys have oxygen content of less than 0.1 wt. %. Further, the products, e.g., flat rolled products, are substantially free of the as-cast structure.

As well as providing the alloy product with controlled amounts of alloying elements as described herein, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. The ingot or billet may be preliminarily worked or shaped to provide suitable stock for subsequent working operations. Prior to the principal working operation, the alloy stock is preferably subjected to homogenization, and preferably at metal temperatures in the range of 850° to 1050° F. for a period of time of at least one hour to dissolve soluble elements and to homogenize the internal structure of the metal. A preferred time period is about 20 hours or more in the homogenization temperature range. Normally, the heat up and homogenization treatment does not have to extend for more than 40 hours; however, longer times are not normally detrimental. A time of 20 to 40 hours at the homogenization temperature has been found quite suitable.

Figure 2:
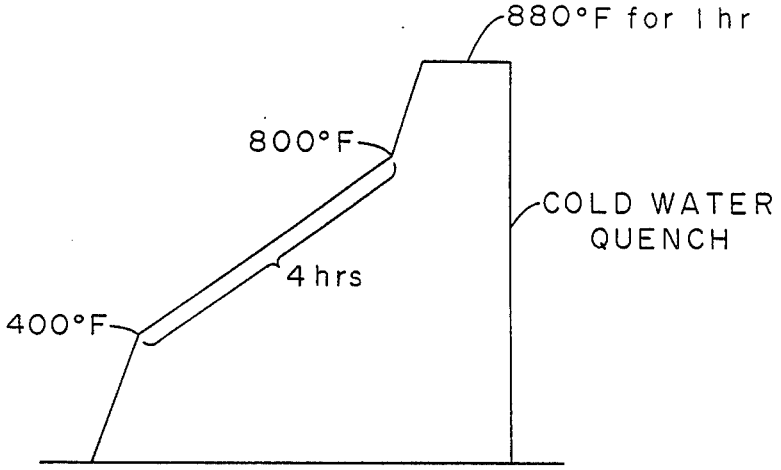
FIG. 2 is a diagram of a ramp anneal in accordance with the invention.

In one aspect of the present invention, to produce an unrecrystallized flat rolled product, the ingot may be rolled to a final gauge product. Then, the product is subjected to an annealing treatment wherein annealing temperature is increased with time of anneal and referred to herein as a ramp anneal. In the anneal practice, the starting temperature can be as high as 750° F. and then increased with anneal time to temperatures higher than 750° F., e.g. 850° F. With respect to higher starting temperatures, a typical starting temperature is 730° F. and the temperature can then be increased with time to about 800° F. When lower ramp anneal temperatures are used, starting temperatures do not usually exceed 550° F., normally 400° F., with a typical starting temperature being in the range of 350° to 450° F. and an ending temperature being in the range of 650° to 850° F. Typical ending temperatures are in the range of 750° to 850° F., depending on the alloy composition. In the ramp anneal, the temperature can be increased at a rate of 2° to 100°/hr, and preferably at a rate of 5° to 80°/hr. The time from the beginning to the end of the ramp anneal can range from 3 to about 10 hours, with typical times being in the range of 2 to 8 hours. The ramp anneal can include a series of increases in temperature with a holding time at temperature plateau or series of plateaus. Further, it can include even increases in temperature followed by decreases in temperature until the final ending temperature is reached. Also, there may be even holding plateaus at any one or more temperature level. It will be understood that in some cases, as the anneal temperature gets higher, an independent solution heat treatment may not be necessary but, instead, is included as part of the ramp anneal, as shown in FIGS. 1 and 2, or the product may be cooled and a separate solution heat treatment, quench and aging performed. In certain alloys, to obtain an unrecrystallized product, it may be desirable to combine these processes. That is, the ramp anneal may be used in addition to precipitation heat treating intermediate the working steps, and such combination is contemplated within the purview of the invention.

An unrecrystallized thin gauge plate or sheet product may be produced as in my copending application entitled "Method of Producing Unrecrystallized Thin Gauge Aluminum Products", Ser. No. 256,521, filed Oct. 12, 1988, incorporated herein by reference. By unrecrystallized is meant the absence of well-developed grains and the presence of a highly worked structure containing recovered subgrain and retaining as-worked crystallographic texture, i.e., at least 60% of the plate or sheet is free of well-developed grains or retains the as-worked texture. In this process, the thermomechanical steps should be carefully controlled. Thus, after homogenization of the ingot and hot rolling to a slab dimension, the hot rolling performed at temperatures in the range of 500° to 900° F., the slab is reheated typically to a temperature in the range of 650° to 900° F. and preferably 650° or 700° to 800° F. (depending upon composition), for purposes of dissolving or partially dissolving particles that precipitated during the preceding thermal mechanical operation. Reheating can be carried out in a time as short as ¼, or ½ hour at temperature, and can extend for 4 hours or more. However, the longer times are not normally necessary. Then, the slab is cooled at a rate sufficient to retain dissolved elements in solution. Preferably, the slab is cold water quenched or rapidly cooled. Thereafter, the slab is subjected to an elevated temperature precipitation heat treatment to precipitate particles in a controlled manner. The precipitation heat treatment can be carried out at a temperature in the range of 200° to 550° F., preferably 350° to 500° F., with typical temperatures being 400° to 500° F. Precipitation heat treatment times at this temperature can range from 5 to 20 hours or longer, and times of from 9 to 15 hours can be quite suitable. After the precipitation heat treatment, the slab is worked or rolled to thin gauge plate or to sheet stock. Thin gauge plate contemplates having a thickness of at least 0.125, typically 0.25 inch or more. The thickness can extend to 0.5 inch or more, for example, 0.75 or 1.0 or even 1.25 inch.

While the slab may be cold rolled at these temperatures, it is preferred that the slab be rolled to final gauge, e.g., thin gauge plate or sheet, using warm rolling practices. Thus, preferably, warm rolling is performed at a temperature of not greater than 550° F. Further, preferably, the temperature at which warm rolling begins is not less than 200° F. Typically, the warm rolling can begin at the precipitation heat treatment temperature. Preferably, the warm rolling temperature should not exceed the precipitation heat treatment temperature. Such temperatures are in the range of about 350° to 500° F. This warm rolling practice contrasts with the prior art which teaches that rolling temperatures should be significantly higher, typically above about 750° F.

Optionally, the plate or sheet product is subjected to a solution heat treatment and then cooled, for example, by cold water quenching.

The solution heat treatment is preferably accomplished at a temperature in the range of 800° to 1050° F. and unrecrystallized grain structure is produced. Generally, for sheet gauge typical times at temperatures can be relatively short, e.g., 5 minutes or less can be adequate. For thin gauge plate 0.5 inch, the time at temperature can be ¼ to 5 hours, typically 2 hours.

To further provide for the desired strength and fracture toughness necessary to the final product and to the operations in forming that product, the product should be rapidly quenched to prevent or minimize uncontrolled precipitation of strengthening phases. Thus, it is preferred in the practice of the present invention that the quenching rate be at least 100° F. per second from solution temperature to a temperature of about 200° F. or lower. A preferred quenching rate is at least 200° F. per second in the temperature range of 900° F. or more to 200° F. or less. After the metal has reached a temperature of about 200° F., it may then be air cooled.

After the alloy product of the present invention has been quenched, it may be subjected to a subsequent aging operation to provide the combination of fracture toughness and strength which are so highly desired in aircraft members. Artificial aging can be accomplished by subjecting the sheet or plate or shaped product to a temperature in the range of 150° to 400° F. for a sufficient period of time to further increase the yield strength. Some compositions of the alloy product are capable of being artificially aged to a yield strength as high as 100 ksi. However, the useful strengths are in the range of 70 to 90 ksi and corresponding fracture toughnesses are in the range of 20 to 50 ksi$\sqrt{\text{in}}$. Preferably, artificial aging is accomplished by subjecting the alloy product to a temperature in the range of 275° to 375° F. for a period of at least 30 minutes. A suitable aging practice contemplates a treatment of about 8 to 24 hours at a temperature of about 325° F. Further, it will be noted that the alloy product in accordance with the present invention may be subjected to any of the typical overaging or underaging treatments well known in the art, including natural aging. However, it is presently believed that natural aging provides the least benefit. Also, while reference has been made herein to single aging steps, multiple aging steps, such as two or three aging steps, are contemplated and stretching or its equivalent working may be used prior to or even after part of such multiple aging steps.

While the invention has been described with respect to sheet and plate, it will be appreciated that its application is not necessarily limited thereto. That is, the process can be applied to extrusions and forgings having alloy compositions referred to herein or responsive to these treatments. In contrast to rolling, for extrusion purposes, it is not difficult to keep the ingot hot, but it is uneconomical to do so because of the slow extruding rates. Consequently, extrusions typically have a recrystallized structure. To provide an unrecrystallized extrusion in accordance with the invention, the process would include two or more extruding steps. That is, after achieving an ingot temperature of about 700° to 800°, the ingot is extruded to an intermediate cross-sectional area, e.g., to reduce the area 75%. Thereafter, the partially extruded material is subjected to a reheating step, for example, under the same conditions as referred to herein with respect to slab. Also, it is cooled and subjected to an elevated precipitation treatment as referred to for slab, for example. Thereafter, the partial extrusion is further worked or extruded to product form preferably utilizing warm temperatures, for example, under the same conditions referred to for slab being rolled to final gauge. Thereafter, the extrusion may be solution heat treated, quenched and aged to produce an unrecrystallized aluminum alloy extrusion. Because the steps to form forgings are often repeated, the forging operation may be carried out incorporating the procedures set forth for the flat rolled product to produce an unrecrystallized aluminum alloy forged product. It will be appreciated that the rolling, extruding or forging steps may be combined to produce an unrecrystallized product.

This practice of ramp annealing is suitable for use in many applications. That is, it may be used quite successfully regardless of the previous thermomechanical practices. For example, it has been used on thin gauge plate where the slab was reheated, quenched, heat treated and warm rolled to a plate product, described earlier herein, to produce a thoroughly or completely unrecrystallized product (see Example 3).

EXAMPLE 1

An aluminum alloy consisting essentially of, by weight percent, 10 Zn, 1.8 Mg, 1.5 Cu and 0.12 Zr, the balance essentially aluminum and impurities was cast into an ingot suitable for rolling. The ingot was homogenized and hot rolled at about 800° F. to a 1.5 inch thick slab. The slab was cut into several pieces which were heated to temperatures of 750° to 880° F. and then hot rolled starting at about 750° F. to 0.3 inch thick plate. Samples were given a ramp anneal starting at a temperature of 730° F. and ending at 800° F., with a heat-up rate of about 10° F./hr. After annealing, these samples, along with unannealed samples, were heated to 880° F. and solution heat treated at this temperature for 1 hour and then cold water quenched, as shown in FIG. 1. Examination of the microstructure revealed that the degree of recrystallization of the ramp annealed samples was significantly reduced compared to the microstructure of samples which were not annealed in this manner.

EXAMPLE 2

Samples of 0.3 inch plate having the composition and prepared as in Example 1 were subjected to a ramp anneal starting at a temperature of 400° and ending at a temperature of 800° F., the increase in temperature being performed in 4 hours, as shown in FIG. 2. These samples were solution heat treated as in Example 1. Examination of the microstructure showed a basically unrecrystallized grain structure.

EXAMPLE 3

This sample (0.3 inch plate) had the same composition and treated as in Example 2 except that prior to hot rolling to 0.3 inch thick plate, the sample was reheated to 750° F. for about 0.5 hours, cold water quenched and then precipitation heat treated at 400° F. for 12 hours and hot rolled to 0.3 inch thick plate starting at a temperature of 400° F. The microstructure of this sample revealed a completely unrecrystallized grain structure.

Having thus described the invention, what is claimed is:

1. A method of producing an unrecrystallized aluminum based thin gauge flat rolled, heat treated product having improved levels of strength and fracture toughness, the method comprising the steps of:

(a) providing a body of a aluminum base heat treatable alloy;

(b) working the body to a wrought product;

(c) subjecting said product to a ramp anneal wherein the anneal is started at a temperature of less than 750° F. and the temperature is increased at a rate of 2° to 100° F./hr.; and (d) solution heat treating, quenching and aging said final gauge flat rolled product to provide a substantially unrecrystallized product having improved levels of strength and fracture toughness.

2. The method in accordance with claim 1 wherein said wrought product in a thin flat rolled product having a thickness of less than 1.0 inch.

3. The method in accordance with claim 2 wherein said flat rolled product is a thin gauge plate product having a thickness of 0.25 to 0.75.

4. The method in accordance with claim 2 wherein said flat rolled product is a thin gauge plate product having a thickness of 0.25 to 0.5.

5. The method in accordance with claim 2 wherein said flat rolled product is a sheet product.

6. The method in accordance with claim 1 wherein the working is hot working which is performed at a temperature in the range of 600° to 900° F.

7. The method in accordance with claim 1 wherein working is hot rolling.

8. The method in accordance with claim 7 wherein hot rolling is performed starting at a temperature of at least 500° F.

9. The method in accordance with claim 1 wherein the anneal starts at a temperature of not greater than 400° F.

10. The method in accordance with claim 1 wherein the anneal ends at a temperature in the range of 650° to 850° F.

11. The method in accordance with claim 1 wherein in the anneal the temperature is increased at a rate of 5°/hr to 80°/hr.

12. The method in accordance with claim 1 wherein the anneal starts at a temperature in the range of 350° to 450° F. and is increased to a temperature in the range of 750° to 850° F. in a period of about 2 to 8 hours.

13. The method in accordance with claim 1 wherein solution heat treating is performed at a temperature in the range of 800° to 1050° F.

14. The method in accordance with claim 1 wherein solution heat treating is performed for a period in the range of ¼ to 5 hours.

15. The method in accordance with claim 1 wherein the quench is a cold water quench.

16. The method in accordance with claim 1 wherein the alloy is selected from 2000, 6000 and 7000 type aluminum alloys.

17. The method in accordance with claim 16 wherein the alloy is selected from 2000 type aluminum alloys.

18. The method in accordance with claim 16 wherein the alloy is selected from 6000 type aluminum alloys.

19. The method in accordance with claim 17 wherein the alloy is selected from Aluminum Association alloys: 2024, 2124, 2324, 2219, 2519, 2014 and 2618.

20. The method in accordance with claim 18 wherein the alloy is selected from Aluminum Association alloys 6061 and 6013.

21. The method in accordance with claim 1 wherein the aluminum alloy is a Zn-Cu-Mg type alloy.

22. The method in accordance with claim 1 wherein the alloy is selected from 7050, 7150, 7075, 7475, 7049 and 7039.

23. The method in accordance with claim 1 wherein the alloy contains 1.0 to 12 wt. % Zn, 0.5 to 4.0 wt. % Mg, max. 3.0 wt. % Cu, max. 1.0 wt. % Mn, max. 0.5 wt. % each of Si, Fe, Cr, Ti, Zr, Sc, Hf, the balance aluminum and impurities.

24. The method in accordance with claim 1 wherein the alloy contains 7.0 to 9.0 wt. % Zn, 1.5 to 2.5 wt. % Mg, 1.9 to 2.7 wt. % Cu, 0.08 to 0.14 wt. % Zr, max. 0.5 wt. % each of Si, Fe, Cr, Ti, Zr, Sc and Hf, the balance aluminum and impurities.

25. A method of producing an unrecrystallized Al-Zn-Mg thin plate or sheet product having improved levels of strength and fracture toughness, the method comprising the steps of:

(a) providing a body of an alloy consisting essentially of 1.0 to 12 wt. % Zn, 0.5 to 4.0 wt. % Mg, max. 3.0 wt. % Cu, max. 1.0 wt. % Mg, max. 0.5 wt. % each of Si, Fe, Cr, Ti, Zr, Sc, Hf, the balance aluminum and impurities;

(b) hot rolling the body to a flat rolled product;

(c) subjecting said product to a ramp anneal wherein the anneal temperature is started at a temperature of less than 750° F. and the temperature is increased at a rate of 2° to 100°/hr; and (d) solution heat treating, quenching and aging said flat rolled product to provide a substantially unrecrystallized product having improved levels of strength and fracture toughness.

26. The method in accordance with claim 25 wherein said flat rolled product is a thin gauge plate product.

27. The method in accordance with claim 25 wherein said flat rolled product is a thin gauge plate product having a thickness of 0.25 to 0.75.

28. The method in accordance with claim 25 wherein said flat rolled product is a thin gauge plate product having a thickness of 0.25 to 0.5.

29. The method in accordance with claim 25 wherein said flat rolled product is a sheet product.

30. The method in accordance with claim 25 wherein hot rolling is performed at a temperature in the range of 500° to 900° F.

31. The method in accordance with claim 25 wherein hot rolling is performed starting at a temperature of at least 700° F.

32. The method in accordance with claim 25 wherein the anneal starts at a temperature less than 400° F.

33. The method in accordance with claim 25 wherein the anneal starts at a temperature in the range of 400° to 750° F.

34. The method in accordance with claim 25 wherein the anneal ends at a temperature in the range of 650° to 850° F.

35. The method in accordance with claim 25 wherein the anneal temperature is increased at a rate of 5° to 80°/hr.

36. The method in accordance with claim 25 wherein the anneal starts at a temperature in the range of 350° to 450° F. and is increased to a temperature in the range of 750° to 850° F. in a period of about 2 to 6 hours.

37. The method in accordance with claim 25 wherein solution heat treating is performed at a temperature in the range of 800° to 1050° F.

38. The method in accordance with claim 25 wherein solution heat treating is performed for a period in the range of ¼ to 5 hours.

39. The method in accordance with claim 25 wherein the quench is a cold water quench.

40. The method in accordance with claim 25 wherein the aluminum alloy is a Zn-Cu Mg type alloy.

41. The method in accordance with claim 25 wherein the alloy is selected from 7050, 7150, 7075, 7475, 7049 and 7039.

42. The method in accordance with claim 25 wherein the alloy contains 1.0 to 12 wt. % Zn, 0.5 to 4.0 wt. % Mg, max. 3.0 wt. % Cu, max. 1.0 wt. % Mn, max. 0.5 wt. % each of Si, Fe, Cr, Ti, Zr, Sc, Hf, the balance aluminum and impurities.

43. The method in accordance with claim 25 wherein the alloy is 7050.

44. The method in accordance with claim 25 wherein the alloy is 7150.

45. The method in accordance with claim 25 wherein the alloy is 7075.

46. The method in accordance with claim 25 wherein the alloy is 7475.

47. A method of producing an unrecrystallized Al-Zn-Mg type thin plate or sheet product having improved levels of strength and fracture toughness, the method comprising the steps of:

(a) providing a body of an alloy consisting essentially of 7.0 to 9.0 wt. % Zn, 1.5 to 2.5 wt. % Mg, 1.9 to 2.7 wt. % Cu, 0.08 to 0.14 wt. % Zr, max. 0.12 wt. % Si, max, 0.15 wt. % Fe, max. 0.10 wt. % Mn, max. 0.06 wt. % Ti, max. 0.04 wt. % Cr, the balance aluminum and incidental elements and impurities;

(b) hot rolling the body to a final gauge product;

(c) subjecting said product to a ramp anneal wherein the anneal temperature is started at a temperature of less than 750° F. and the temperature is increased at a rate of 2° to 100° F./hr; and (d) solution heat treating, quenching and aging said final gauge product to provide a substantially unrecrystallized product having improved levels of strength and fracture toughness.

48. A method of producing an unrecrystallized type aircraft structural member having improved levels of strength and fracture toughness, the method comprising the steps of:

(a) providing a body of a heat treatable aluminum base alloy selected from AA2000 and 7000 type aluminum alloys;

(b) working the body to a flat rolled product;

(c) subjecting said product to a ramp anneal wherein the anneal is started at a temperature of less than 750° F. and the temperature is increased at a rate of 2° to 100° F./hr.;

(d) solution heat treating, quenching and aging said product to provide a substantially unrecrystallized product having improved levels of strength and fracture toughness; and (e) forming said unrecrystallized product into said aircraft structural member.

49. The method in accordance with claim 48 wherein the aluminum base alloy is an AA7000 type alloy.

50. The method in accordance with claim 48 wherein said flat rolled product is a thin gauge plate product.

51. The method in accordance with claim 48 wherein said flat rolled product is a thin gauge plate product having a thickness of 0.25 to 0.75.

52. The method in accordance with claim 48 wherein said flat rolled product is a thin gauge plate product having a thickness of 0.25 to 0.5.

53. The method in accordance with claim 48 wherein said flat rolled product is a sheet product.

54. The method in accordance with claim 48 including the step of heating the body to a hot working temperature and said working is hot rolling.

55. The method in accordance with claim 54 wherein hot rolling is performed starting at a temperature in the range of 500° to 900° F.

56. The method in accordance with claim 48 wherein the anneal starts at a temperature in the range of 350° to 750° F.

57. The method in accordance with claim 48 wherein the anneal ends at a temperature in the range of 650° to 850° F.

58. The method in accordance with claim 48 wherein the anneal temperature is increased at a rate of 5° to 80°/hr.

59. The method in accordance with claim 48 wherein the anneal starts at a temperature in the range of 350° to 450° F. and is increased to a temperature in the range of 750° to 850° F. in a period of about 2 to 6 hours.

60. The method in accordance with claim 48 wherein solution heat treating is performed at a temperature in the range of 800° to 1050° F.

61. The method in accordance with claim 48 wherein solution heat treating is performed for a period in the range of ¼ to 5 hours.

62. The method in accordance with claim 48 wherein the quench is a cold water quench.

63. The method in accordance with claim 48 wherein the aluminum alloy is a Zn-Cu-Mg type alloy.

64. The method in accordance with claim 48 wherein the alloy is selected from 7050, 7150, 7075, 7475, 7049 and 7039.

65. The method in accordance with claim 48 wherein the alloy contains 1.0 to 12 wt. % Zn, 0.5 to 4.0 wt. % Mg, max. 3.0 wt. % Cu, max. 1.0 wt. % Mn, max. 0.5 wt. % each of Si, Fe, Cr, Ti, Zr, Sc, Hf, the balance aluminum and impurities.

66. A method of producing an unrecrystallized type aircraft structural member having improved levels of strength and fracture toughness, the method comprising the steps of:

(a) providing a body of an aluminum base alloy consisting essentially of 7.0 to 9.0 wt. % Zn, 1.5 to 2.5 wt. % Mg, 1.9 to 2.7 wt. % Cu, 0.08 to 0.14 wt. % Zr, max. 0.12 wt. % Si, max. 0.15 wt. % Fe, max. 0.10 wt. % Mn, max. 0.06 wt. % Ti, max. 0.04 wt. % Cr, the balance aluminum and incidental elements and impurities, (b) working the body to a flat rolled product;

(c) subjecting said product to a ramp anneal wherein the anneal is started at a temperature of less than 750° F. and the temperature is increased at a rate of 2° to 100° F./hr.;

(d) solution heat treating, quenching and aging said product to provide a substantially unrecrystallized product having improved levels of strength and fracture toughness; and (e) forming said unrecrystallized product into said aircraft structural member.

67. An aluminum alloy unrecrystallized aircraft structural member comprised of an aluminum base alloy consisting essentially of 1.0 to 12 wt. % Zn, 0.5 to 4.0 wt. % Mg, max. 3.0 wt. % Cu, max. 1.0 wt. % Mn, max. 0.5 wt. % each of Si, Fe, Cr, Ti, Zr, Sc, Hf, the balance aluminum and impurities, the structural member formed from unrecrystallized plate resulting from ramp annealing said product where the temperature is increased from a temperature less than 750° F. to a temperature of less than 850° F. and the temperature is increased at a rate of 2° to 100° F./hr.

68. The member in accordance with claim 67 wherein said plate is a thin gauge plate product.

69. The member in accordance with claim 67 wherein said plate is a thin gauge plate product having a thickness of 0.25 to 0.75.

70. The member in accordance with claim 67 wherein said plate is a thin gauge plate product having a thickness of 0.25 to 0.5.

71. The member in accordance with claim 67 wherein said plate is a sheet product.

72. An aluminum alloy member in accordance with claim 67 wherein the alloy contains 5.7 to 6.9 wt. % Zn, 1.9 to 2.7 wt. % Mg, 1.9 to 2.6 wt. % Cu, 0.05 to 0.15 wt. % Zr, max. 0.12 wt. % Si, max. 0.15 wt. % Fe, max. 0.10 wt. % Mn, max. 0.06 wt. % Ti, max. 0.04 wt. % Cr, the balance aluminum and incidental elements and impurities, the thin gauge plate product having a thickness in the range of 0.25 to 0.5 inch.

73. An aluminum alloy member in accordance with claim 67 wherein the plate is 0.25 to 1.50 inch thick.

74. An aluminum alloy member in accordance with claim 67 wherein the plate is 0.25 to 1.0 inch thick.

75. An aluminum alloy member in accordance with claim 67 wherein after ramp annealing the plate is solution heat treated, quenched and aged.

76. An unrecrystallized thin gauge plate product suitable for fabricating into aircraft structural panel members, the unrecrystallized thin gauge plate product comprised of aluminum base alloy consisting essentially of 5.7 to 6.9 wt. % Zn, 1.9 to 2.7 wt. % Mg, 1.9 to 2.6 wt. % Cu, 0.05 to 0.15 wt. % Zr, max. 0.12 wt. % Si, max. 0.15 wt. % Fe, max. 0.10 wt. % Mn, max. 0.06 wt. % Ti, max. 0.04 wt. % Cr, the balance aluminum and incidental elements and impurities, the thin gauge plate product having a thickness in the range of 0.25 to 0.5 inch and resulting from subjecting the plate to a ramp anneal starting at a temperature below 725° F. and ending at a temperature above 775° F., the temperature being increased at 2° to 100° F./hr followed by solution heat treatment, cold water quench and aging.

77. The product in accordance with claim 76 wherein the member is an upper wing skin.

78. An unrecrystallized thin gauge plate product suitable for fabricating into aircraft structural members, the unrecrystallized thin gauge plate product comprised of aluminum base alloy consisting essentially of 7.0 to 9.0 wt. % Zn, 1.5 to 2.5 wt. % Mg, 1.9 to 2.7 wt. % Cu, 0.08 to 0.14 wt. % Zr, max. 0.12 wt. % Si, max. 0.15 wt. % Fe, max. 0.10 wt. % Mn, max. 0.06 wt. % Ti, max. 0.04 wt. % Cr, the balance aluminum and impurities, the thin gauge plate product having a thickness in the range of 0.25 to 0.5 inch and resulting from subjecting the final gauge plate to a ramp anneal starting at a temperature below 725° F. and ending at a temperature above 775° F., the temperature being increased at 2° to 100° F./hr followed by solution heat treatment, cold water quench and aging.

* * * * *